US005178906A

United States Patent [19]

Patel et al.

[11] Patent Number: 5,178,906

[45] Date of Patent: Jan. 12, 1993

[54] METHOD OF MANUFACTURING A PHOSPHOR SCREEN FOR A CRT USING AN ADHESION-PROMOTING, BLISTER-PREVENTING SOLUTION

[75] Inventors: Himanshu M. Patel, Rome; Gabriele Giancaterini, Frosinone, both of Italy

[73] Assignee: Videocolor, Anagni, Italy

[21] Appl. No.: 789,708

[22] Filed: Nov. 8, 1991

[30] Foreign Application Priority Data

Apr. 9, 1991 [IT] Italy ..... 00976 A/91

[51] Int. Cl.[5] ..... B05D 5/06

[52] U.S. Cl. ..... 427/64; 427/68; 427/226; 427/404; 427/407.2

[58] Field of Search ..... 427/64, 68, 226, 404, 427/407.2

[56] References Cited

U.S. PATENT DOCUMENTS

| | | | |
|---|---|---|---|
| Re. 30,643 | 6/1981 | Nill et al. | 427/69 |
| 3,067,055 | 12/1962 | Saulnier | 117/33.5 |
| 3,582,389 | 6/1971 | Saulnier | 117/33.5 |
| 3,582,390 | 6/1971 | Saulnier | 117/35 |
| 3,652,323 | 3/1972 | Smith | 117/97 |
| 4,123,563 | 10/1978 | Mitobe et al. | 427/68 |
| 4,212,902 | 7/1980 | Lopez | 427/68 |
| 4,327,123 | 4/1982 | Levine et al. | 427/68 |
| 4,339,475 | 7/1982 | Hinosugi et al. | 427/64 |
| 4,550,032 | 10/1985 | Compen et al. | 427/68 |
| 4,990,366 | 2/1991 | Pezzulo et al. | 427/68 |

*Primary Examiner*—Janyce Bell

*Attorney, Agent, or Firm*—Joseph S. Tripoli; Dennis H. Irlbeck; Vincent J. Coughlin, Jr.

[57] ABSTRACT

The invention relates to a method for manufacturing a phosphor screen on an inner surface of a CRT panel, having a faceplate, a blend radius, and a sidewall. The method includes the steps of depositing at least one phosphor layer (R, G, B), containing a binder, on the inner surface of the faceplate, and then coating the phosphor layer, the blend radius, and at least a portion of the sidewall with a filming material. The coating of the filming material is dried to form a film. The film, or at least that portion thereof overlying the blend radius and the side wall, is contacted with an adhesion-promoting, blister-reducing solution which contains operable quantities of silica particles, a low vapor pressure alcohol and deionized water. A metal layer is deposited on the film, and the film and the binder contained in the phosphor layer are volatilized.

10 Claims, 2 Drawing Sheets

METHOD OF MANUFACTURING A PHOSPHOR SCREEN FOR A CRT USING AN ADHESION-PROMOTING, BLISTER-PREVENTING SOLUTION

The invention relates to a method of manufacturing a phosphor screen on an inner surface of a faceplate panel of a cathode-ray tube (CRT) and, more particularly, to a method of contacting at least a portion of a film on said panel with a novel adhesion-promoting, blister-preventing solution.

BACKGROUND OF THE INVENTION

U.S. Pat. No. Re. 30,643, issued on Jan. 9, 1981 to E. Nill et al., describes a method of aluminizing the inside of the panel of a television picture tube. A lacquer film is deposited over the phosphor materials of the screen, to provide a smooth surface on which an aluminum layer is condensed. Because both the film and the aluminum layer cover not only the phosphors but also the smooth lateral surfaces of the panel, the portion of the lacquer on the sidewall is roughened prior to aluminum deposition so that gas, released during the volatilization of the organic materials in the screen and film, can escape through small openings in the aluminum layer, thereby preventing blistering of the layer. To roughen the lateral surface, boric acid is sprayed on the lacquer film. The method described in U.S. Pat. No. Re. 30,643 has the drawback that boric acid does not promote sufficient adhesion between the aluminum layer and the glass surface of the lateral portion of the panel. Consequently, even if blistering of the aluminum layer does not occur during panel bake, flaking of the aluminum layer may still occur, thereby generating undesirable conductive particles within the tube. An additional drawback is that if any of the boric acid is oversprayed onto the phosphor screen, the boron in the boric acid reduces the efficiency of the ZnS:Ag blue phosphor, resulting in a dark or yellow appearance of the affected phosphor.

U.S. Pat. No. 3,582,389, issued on Jun. 1, 1971 to T. A. Saulnier, Jr., discloses an aqueous filming emulsion of acrylate copolymers including at least one of four possible additives. The additives may include colloidal silica and a soluble silicate. The panel containing the phosphor screen is heated to about 40° to 46° C. immediately prior to filming. The purpose of the colloidal silica and the soluble silicate in the filming emulsion is to reduce peeling of the metal layer from the bare glass areas of the panel after the bake-out step. In making films with emulsions which have a minimum film-forming temperature above room temperature, sufficient heat must be applied to the panel to cause the film to dry rapidly in order to accumulate emulsion solids over the phosphor area. However, the inclusion of colloidal silica in the filming emulsion does not completely eliminate the formation of blisters in the aluminum layer overlying the blend radius, i.e., the smooth, sharply curved portion of the panel, and the sidewall.

U.S. Pat. No. 4,990,366, issued to A. Pezzulo et al. on Feb. 5, 1991, discloses a solution applied over the dried filming emulsion, to the blend radius and to the sidewall, to promote adhesion and prevent blistering of the subsequently deposited aluminum layer. The solution contains 1 to 3 percent, by weight, of a constituent such as oxalic acid, or ammonium oxalate, or a colloidal silica, or boric acid. Because the screen is heated to a temperature above the minimum film-forming temperature when the filming emulsion is applied, the panel temperature, after the emulsion deposition step, is typically still above the minimum film forming temperature (e.g., about 35° C.) when the adhesion-promoting, blister-preventing solution is applied. If the panel temperature drops below 35° C., the panel must be reheated to above the minimum film-forming temperature before the solution is sprayed thereon, to promote rapid drying of the solution. A drawback of this process is that manufacturing time is increased and the filming apparatus must have additional stations to permit reheating of the panel for the application of the solution.

A need therefore exists for a post-filming process that provides an adhesion-promoting, blister-preventing material on at least the blend radius and sidewall of the panel while maintaining the efficiency of the screen-making process.

SUMMARY OF THE INVENTION

The present invention relates to a method of manufacturing a phosphor screen on an inner surface of a CRT panel. The panel includes a faceplate, a blend radius and a sidewall. The method includes the steps of depositing a phosphor layer, containing a binder, on an inner surface of the faceplate; coating the phosphor layer, the blend radius and at least a portion of the sidewall with a filming material; and drying the coating to form a film. Then, at least the blend radius and the portion of the sidewall having the film thereon are contacted with an adhesion-promoting, blister-preventing solution consisting essentially of operable quantities of silica particles, deionized water, and a low vapor pressure alcohol.

BRIEF DESCRIPTION OF THE DRAWINGS

The novel method for manufacturing a metallized luminescent screen for a cathode-ray tube, such as a color picture tube or a display tube, is illustrated in the block diagram of FIG. 1 and in the panel cross-sectional views of FIGS. 2 and 3.

DETAILED DESCRIPTION OF THE INVENTION

Figure 1:
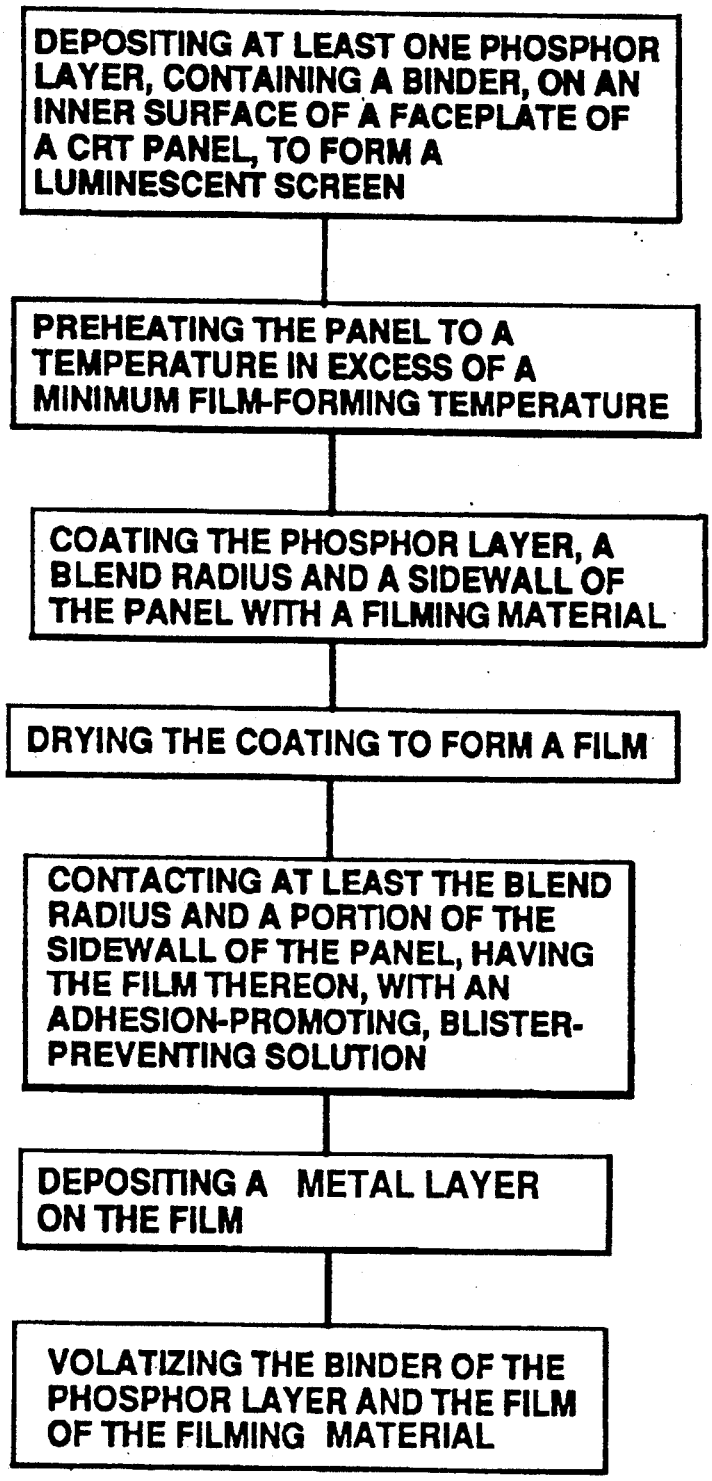
Figure 2:
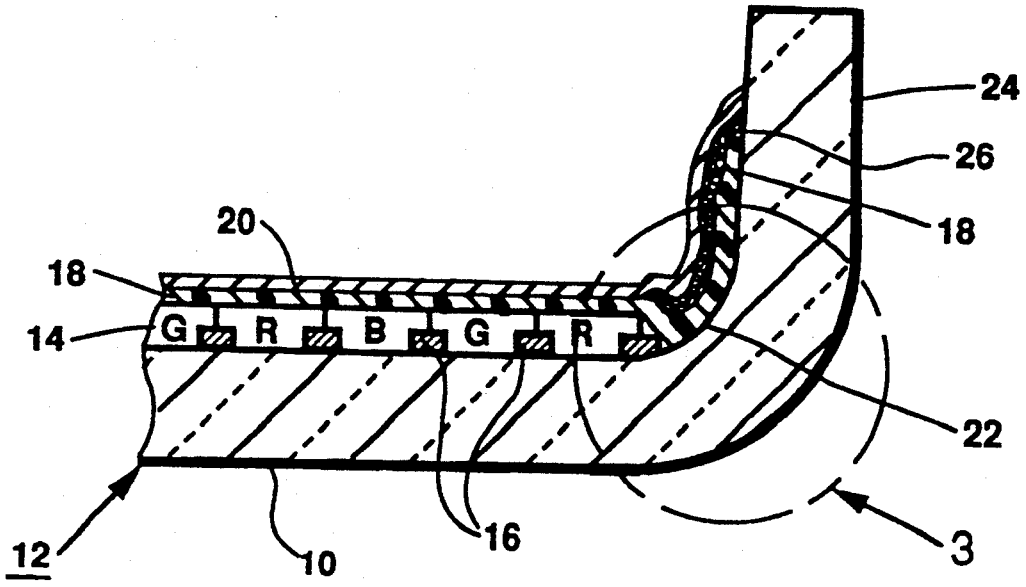
Figure 3:
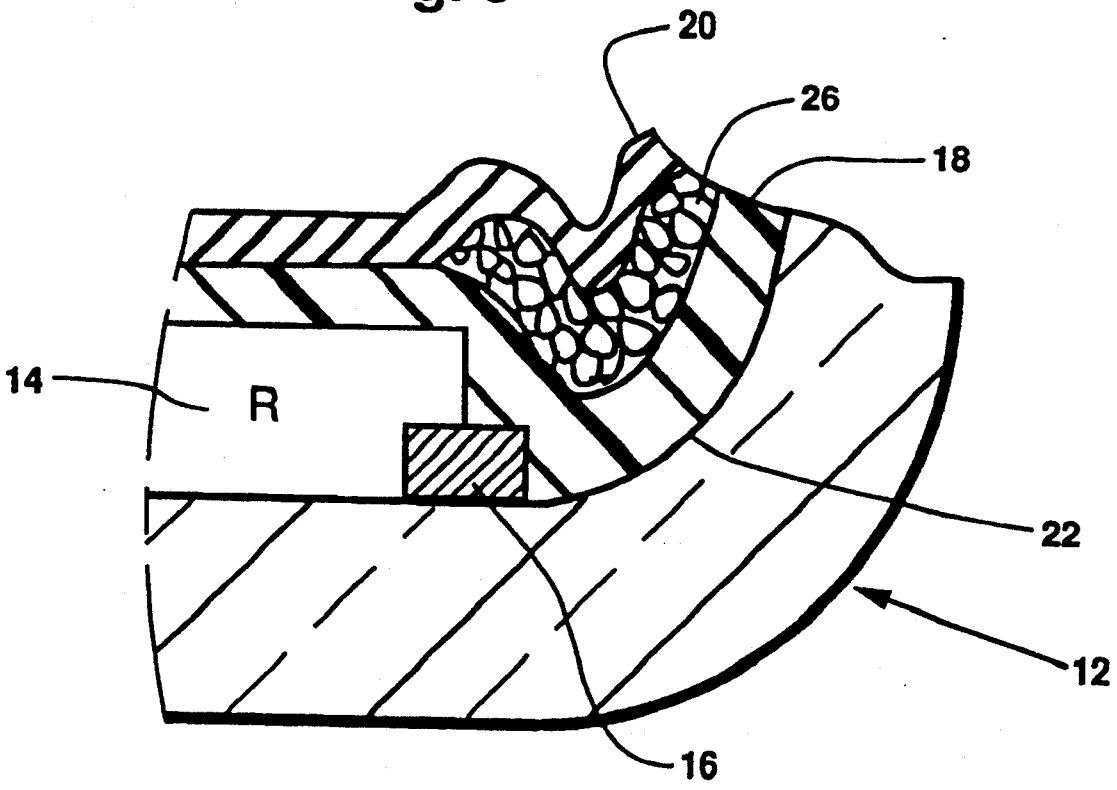

The method of the invention is similar to the prior methods described above, except that the present adhesive-promoting, blister-preventing solution contains a low vapor pressure, preferably methyl or ethyl, alcohol to facilitate the drying of the solution on panels having a temperature within the range, especially, of about 15° to 35° C. The present process thus eliminates the need to reheat the panel, after filming, to facilitate drying of the adhesion-promoting, blister-preventing solution.

At least one, and preferably three layers of successively deposited screen elements comprised of red-emitting (R), green-emitting (G), and blue-emitting (B) phosphor stripes, or dots, are arranged in color groups, or picture elements, in a cyclic order, on an inner surface of a faceplate 10, of a glass panel 12, to form a luminescent screen 14. A matrix line 16, separates each of the adjacent phosphor stripes. Each phosphor layer contains an organic binder, a dichromate sensitizer and one of the color-emitting phosphor materials, as is known in the art.

Following formation of the screen 14, the panel 12 is filmed. Spray filming with an organic, solvent-based film forming solution, or an aqueous emulsion filming, described below, may be used. For emulsion filming, the panel 12 is detachably secured to a holding means (not shown) capable of tilting and rotating the panel at various speeds ranging from 6 to 200 rpm. The panel containing the phosphor screen is rotated in a vertical direction at a speed of 20 to 60 rpm and is preheated with infrared heaters to a temperature slightly in excess of the minimum film-forming temperature of the aqueous filming emulsion. A quantity of a filming emulsion is dispensed onto the rotating panel as a limp stream, which has a trajectory which contacts the surface of the screen substantially tangentially thereto, and passes along the surface and drains therefrom, in the manner described in U.S. Pat. No. 3,652,323, issued to B. K. Smith on Mar. 28, 1972. After the surface of the screen is coated with the filming emulsion, the panel is rotated at a speed of 60 to 200 rpm for about 5 to 30 seconds, to remove the excess emulsion. In practice, the emulsion wets the screen surface readily and fills the screen pores or capillaries, and some of the emulsion solids are distributed over the screen surface, due to inhibition of water from the emulsion. The panel is heated by the infrared heaters to dry the emulsion and to form a substantially continuous, thin, glossy film 18.

Following filming, the dry film is metallized in a manner similar to that described in U.S. Pat. No. 3,067,055, issued on Aug. 5, 1959, and U.S. Pat. No. 3,582,390, issued Jun. 1, 1971, both to T. A. Saulnier, Jr. A thin layer of metal, preferably aluminum, 20 overlies the film 18. Prior to metallization, a novel adhesion-promoting, blister-preventing solution is sprayed onto the inner portion of the panel outside the screen area. The sprayed portion includes at least the blend radius 22 and the skirt, or sidewall, 24. The sprayed material forms a rough surface 26 which provides minute holes in the metallic coating to prevent blistering of the coating during film bakeout. It also increases the adherence of the metal layer 20 to the underlying surface. Unlike prior aqueous solutions of this type, which require that the panel be reheated to a temperature of about 50° C. before the solution is sprayed thereon to facilitate drying of the solution, the present solution, which contains an operable quantity of a low vapor pressure alcohol, in addition to silica particles and water, can be applied, e.g., by spraying, to panels having a panel temperature within the range of 15° to 35° C. The low vapor pressure alcohol ensures that the spray dries immediately upon contact with the panel, thereby eliminating a time-consuming, additional heating step and the expense involved in increasing the length of the process line to include additional heater stations and panel handling equipment.

Where an organic filming lacquer rather than an emulsion film is used, the present adhesion-promoting, blister-preventing solution may also be sprayed on the dry film without reheating the panel.

The adhesion-promoting, blister-preventing solution consists essentially of 0.5 to 10%, by weight, of silica particles; 10 to 80%, by weight, of a low vapor pressure alcohol, such as methyl or ethyl alcohol, although methyl alcohol is preferred for its lower price; and the balance, of deionized water. Preferably, the silica is a colloidal silica, such as LUDOX* AM marketed by E. I. DUPONT DE NEMOURS, Wilmington, Del., although LUDOX* HS, LUDOX* SM, potassium silicate and sodium silicate also may be used. If the panel temperature is within the range of 15° to 35° C., then the preferred concentration of the solution is 3%, by weight, LUDOX* AM; 39 to 58%, by weight, methyl alcohol; and the balance, deionized water. The lower the panel temperature, the greater the alcohol concentration should be to ensure that the solution dries quickly after being sprayed onto the film.

The colloidal silica in the present solution provides a rough surface in contact with the metallization to form small openings therein, through which the gases from the volatilized organic materials in the binder and the film can escape. At screen bake-out temperatures in excess of 380° C., the silica material tends to harden and significantly improves the adhesion of the metallization to the underlying glass surface of the blend radius and sidewall of the panel.

What is claimed is:

1. In a method of manufacturing a phosphor screen on an inner surface of a CRT panel having a faceplate, a blend radius and a sidewall, said method including the steps of depositing at least one phosphor layer, containing a binder, on said inner surface of said faceplate; coating said phosphor layer, said blend radius and at least a portion of said sidewall with a filming material; drying said coating to form a film; depositing a metal layer on said film; and volatilizing the binder contained in said phosphor layer, and said film; wherein the improvement comprises, prior to the step of depositing said metal layer, the additional step of contacting at least said blend radius and said portion of said sidewall having said film thereon with an adhesion-promoting, blister-preventing solution, said solution consisting essentially of 0.5 to 10%, by weight, of silica particles, deionized water, and a low vapor pressure alcohol having a concentration in the range of 10 to 80%, by weight, of said water.

2. The method as described in claim 1, wherein said silica particles are about 3%, by weight.

3. The method as described in claim 2, wherein said silica particles are selected from the group consisting of colloidal silica, potassium silicate and sodium silicate.

4. The method as described in claim 3, wherein said low vapor pressure alcohol is selected from the group consisting of methyl alcohol and ethyl alcohol.

5. The method as described in claim 4, wherein said solution comprises about 3%, by weight, colloidal silica; 39 to 58%, by weight, methyl alcohol; and the balance, deionized water.

6. In a method of manufacturing a phosphor screen on an inner surface of a CRT panel having a faceplate, a blend radius and a sidewall, said method including the steps of depositing at least one phosphor layer on said inner surface of said faceplate; coating said phosphor layer, said blend radius and at least a portion of said sidewall with a filming material; drying said coating to form a film; and depositing a metal layer on said film; wherein the improvement comprises, prior to the step of depositing said metal layer, the additional step of contacting at least said blend radius and said portion of said sidewall having said film thereon with an adhesion-promoting, blister-preventing solution consisting essentially of 0.5 to 10%, by weight, of silica particles, deionized water, and a low vapor pressure alcohol having a concentration in the range of 10 to 80%, by weight, of said water.

7. The method as described in claim 6, wherein said silica particles are about 3%, by weight.

8. The method as described in claim 7, wherein said silica particles are selected from the group consisting of colloidal silica, potassium silicate and sodium silicate.

9. The method as described in claim 8, wherein said low vapor pressure alcohol is selected from the group consisting of methyl alcohol and ethyl alcohol.

10. In a method of manufacturing a CRT having a luminescent screen formed on an inner surface of a glass panel having a blend radius and a sidewall, the method including:

(a) depositing at least one phosphor layer on said inner surface of said faceplate to form said screen, (b) coating said screen, said blend radius and at least a portion of said sidewall with an aqueous filming emulsion, (c) drying said coating to form a film, and (d) depositing a metal layer on said film, wherein the improvement comprises, prior to the step of depositing said metal layer, the additional step of contacting at least said blend radius and said portion of said sidewall having said film thereon with an adhesion-promoting, blister-preventing solution consisting essentially of 0.5 to 10%, by weight, of silica particles selected from the group consisting of colloidal silica, potassium silicate and sodium silicate; deionized water; and a low vapor pressure alcohol selected from the group consisting of methyl alcohol and ethyl alcohol having a concentration in the range of 10 to 80%, by weight, of said water.

* * * * *